US012332013B2

(12) United States Patent
Brown

(10) Patent No.: US 12,332,013 B2
(45) Date of Patent: Jun. 17, 2025

(54) FIREARM WITH DUAL FEED MAGAZINE

(71) Applicant: XCAL IP LLC, Ashburn, VA (US)

(72) Inventor: Jason Kiyoshi Brown, Chantilly, VA (US)

(73) Assignee: XCAL IP LLC, Ashburn, VA (US)

( * ) Notice: Subject to any disclaimer, the term of this patent is extended or adjusted under 35 U.S.C. 154(b) by 0 days.

(21) Appl. No.: 18/367,624

(22) Filed: Sep. 13, 2023

(65) Prior Publication Data

US 2024/0361095 A1 Oct. 31, 2024

Related U.S. Application Data

(60) Provisional application No. 63/462,813, filed on Apr. 28, 2023.

(51) Int. Cl.
*F41A 9/70* (2006.01)

(52) U.S. Cl.
CPC ..... *F41A 9/70* (2013.01)

(58) Field of Classification Search
CPC ..... F41A 9/70
See application file for complete search history.

(56) References Cited

U.S. PATENT DOCUMENTS 2,217,848 A * 10/1940 Schillstrom ..... F41A 9/69 42/50
3,952,441 A * 4/1976 Tant ..... F41A 9/69 42/50
4,139,958 A * 2/1979 Foote ..... F41A 9/71 42/49.02
5,253,442 A * 10/1993 Kim ..... F41A 17/38 89/34
8,819,977 B2 * 9/2014 Corso ..... F41A 9/70 42/49.02
8,887,428 B1 * 11/2014 Lemoine ..... F41A 9/63 42/49.02
9,316,453 B2 * 4/2016 Seeley ..... F41A 9/70
9,797,668 B2 * 10/2017 Hayes ..... F41A 9/69
9,995,547 B2 * 6/2018 Bandini ..... F41C 3/00
10,041,752 B2 * 8/2018 Ladner ..... F41A 9/71
10,274,274 B2 * 4/2019 Kwon ..... F41A 9/24
10,317,153 B2 * 6/2019 Faifer ..... F41A 9/71
10,323,893 B2 * 6/2019 Ramos ..... F41A 9/63
10,345,063 B1 * 7/2019 Taylor ..... F41A 9/65
(Continued)

*Primary Examiner* — Michelle Clement
(74) *Attorney, Agent, or Firm* — Bennet K. Langlotz; Langlotz Patent & Trademark

(57) ABSTRACT

A firearm with dual feed magazine has a frame defining a magazine well and defining a forward and rearward direction, a magazine configured to be received in the magazine well in a retained position, the magazine including a tubular body having an upper end and an opposed lower end, the tubular body defining adjacent first and second elongated passages, a first spring and first follower received in the first elongated passage, a second spring and second follower received in the second elongated passage, the first elongated passage configured to receive a first stack of ammunition, and the second elongated passage configured to receive a second stack of ammunition. The tubular body may include a divider between the first and second elongated passages and is configured to separate the first stack of ammunition from the second stack of ammunition. The divider may be a flat wall.

13 Claims, 12 Drawing Sheets

(56) References Cited

U.S. PATENT DOCUMENTS

| | | | | |
|---|---|---|---|---|
| 10,365,055 | B1 * | 7/2019 | Cross | F41A 9/63 |
| 10,365,056 | B2 * | 7/2019 | McCormick | F41A 9/70 |
| 10,598,467 | B1 * | 3/2020 | McDermit | F41A 9/70 |
| 10,718,582 | B2 * | 7/2020 | Sharkov | F41A 9/70 |
| 10,739,093 | B2 * | 8/2020 | Hogan, Jr. | F41A 9/70 |
| 11,293,708 | B2 * | 4/2022 | Bandini | F41A 9/63 |
| 11,859,938 | B2 * | 1/2024 | Liao | F41B 11/55 |
| 12,055,360 | B2 * | 8/2024 | Young | F41A 9/70 |
| 12,055,361 | B2 * | 8/2024 | Fester | F41A 9/71 |
| 2010/0269389 | A1 * | 10/2010 | Lopez Laparra | F41A 9/69 42/49.01 |
| 2021/0325133 | A1 * | 10/2021 | Kharalampiev | F41A 9/70 |
| 2021/0381796 | A1 * | 12/2021 | Buys | F41A 9/68 |
| 2023/0266084 | A1 * | 8/2023 | Oaks | F41A 9/65 42/50 |
| 2023/0341201 | A1 * | 10/2023 | Brenton | F41A 11/00 |
| 2023/0392890 | A1 * | 12/2023 | Young | F41A 9/69 |

* cited by examiner

FIREARM WITH DUAL FEED MAGAZINE

CROSS-REFERENCE TO RELATED APPLICATION

This application claims the benefit of U.S. Provisional Patent Application No. 63/462,813 filed on Apr. 28, 2023, entitled "DUAL FEED MAGAZINE," which is hereby incorporated by reference in its entirety for all that is taught and disclosed therein.

FIELD OF THE INVENTION

The present invention relates to firearms, and more particularly to a firearm with dual feed magazine that enables the capacity of the magazine to double while remaining the same size as standard magazines for compatibility with standard magazine pouches.

BACKGROUND AND SUMMARY OF THE INVENTION

A magazine's capacity and the number of magazines that can be carried by an individual are always major considerations for departments, agencies, and individuals who participate in shooting sports or armed service work. The number of bullets in a magazine has always been limited by the height (top to bottom) of the magazine and the width/thickness of the magazine, which determines how many rows of bullets can be organized side by side. Standard magazine pouches used by almost all military and civilian shooters will not support currently available extended magazines or drums.

Therefore, a need exists for a new and improved firearm with dual feed magazine that enables the capacity of the magazine to double while remaining the same size as standard magazines for compatibility with standard magazine pouches. In this regard, the various embodiments of the present invention substantially fulfill at least some of these needs. In this respect, the firearm with dual feed magazine according to the present invention substantially departs from the conventional concepts and designs of the prior art, and in doing so provides an apparatus primarily developed for the purpose of enabling the capacity of the magazine to double while remaining the same size as standard magazines for compatibility with standard magazine pouches.

The present invention provides an improved firearm with dual feed magazine, and overcomes the above-mentioned disadvantages and drawbacks of the prior art. As such, the general purpose of the present invention, which will be described subsequently in greater detail, is to provide an improved firearm with dual feed magazine that has all the advantages of the prior art mentioned above.

To attain this, the preferred embodiment of the present invention essentially comprises a frame defining a magazine well and defining a forward and rearward direction, a magazine configured to be received in the magazine well in a retained position, the magazine including a tubular body having an upper end and an opposed lower end, the tubular body defining adjacent first and second elongated passages, a first spring and first follower received in the first elongated passage, a second spring and second follower received in the second elongated passage, the first elongated passage configured to receive a first stack of ammunition, and the second elongated passage configured to receive a second stack of ammunition. The tubular body may include a divider between the first and second elongated passages and is configured to separate the first stack of ammunition from the second stack of ammunition. The divider may be a flat wall. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
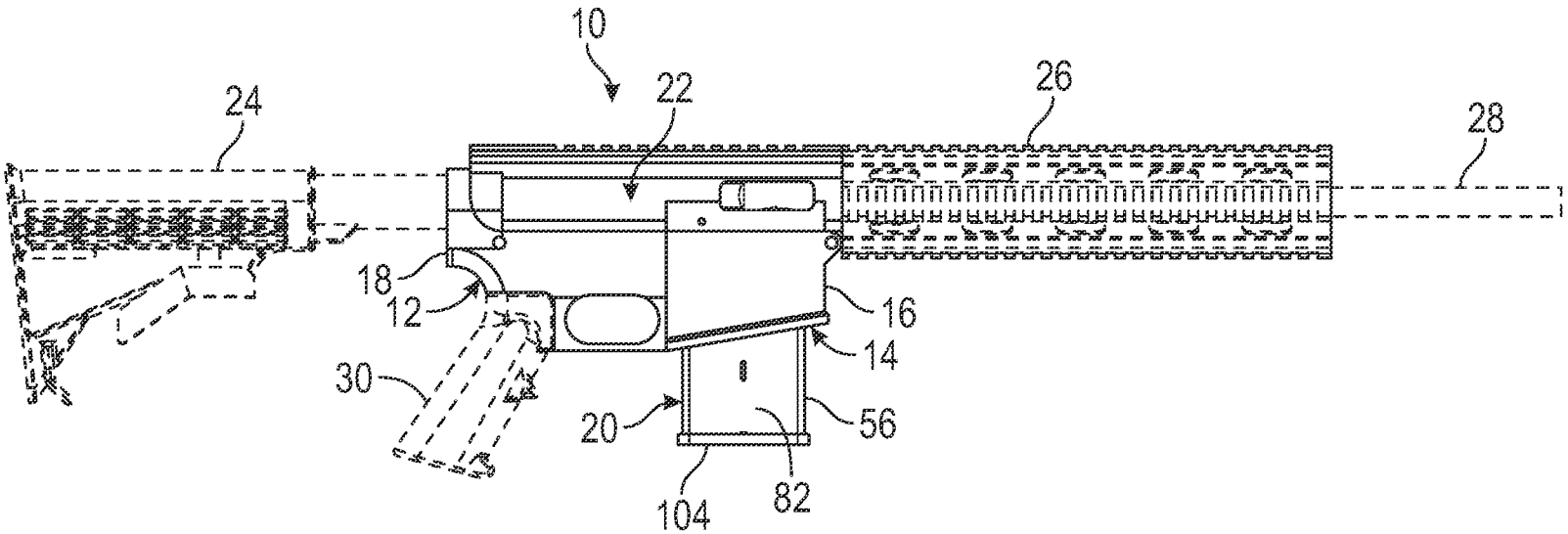
FIG. 1 is a right side view of the current embodiment of a firearm with dual feed magazine constructed in accordance with the principles of the present invention.

An embodiment of the firearm with dual feed magazine of the present invention is shown and generally designated by the reference numeral 10.

Figure 2:
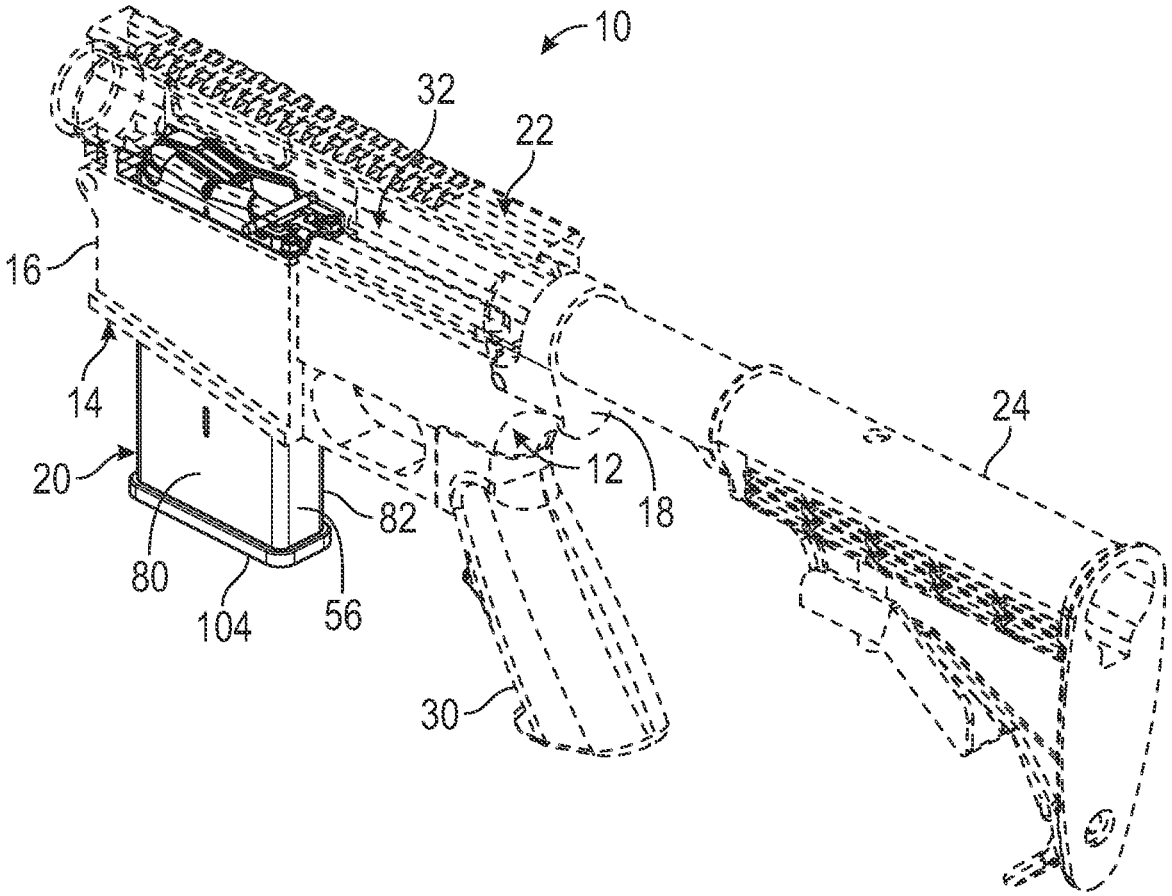
FIG. 2 is an rear isometric view of the firearm with dual feed magazine of FIG. 1 with the barrel and handguard removed.

FIGS. 1 & 2 illustrate the improved firearm with dual feed magazine 10 of the present invention. More particularly, the firearm with dual feed magazine has a frame consisting of a lower receiver 12 and an upper receiver 22. The lower receiver defines a magazine well 14 and defining a forward and rearward direction 16, 18. A magazine 20 is configured to be received in the magazine well in a retained position as shown. The firearm with dual feed magazine also includes a buttstock 24 connected to the rear of the lower receiver, a handguard 26 attached to the front of the upper receiver, a barrel 28 connected to the upper receiver and extending forward from the upper receiver and handguard, and a grip 30 connected to the lower receiver. The upper receiver defines a central bore 32 such that a bolt 34 (shown in FIG. 3) is operable to reciprocate in the upper receiver. It should be appreciated that any standard handguard, barrel, buttstock, and grip can be used with the upper and lower receivers and magazine of the current invention.

Figure 3:
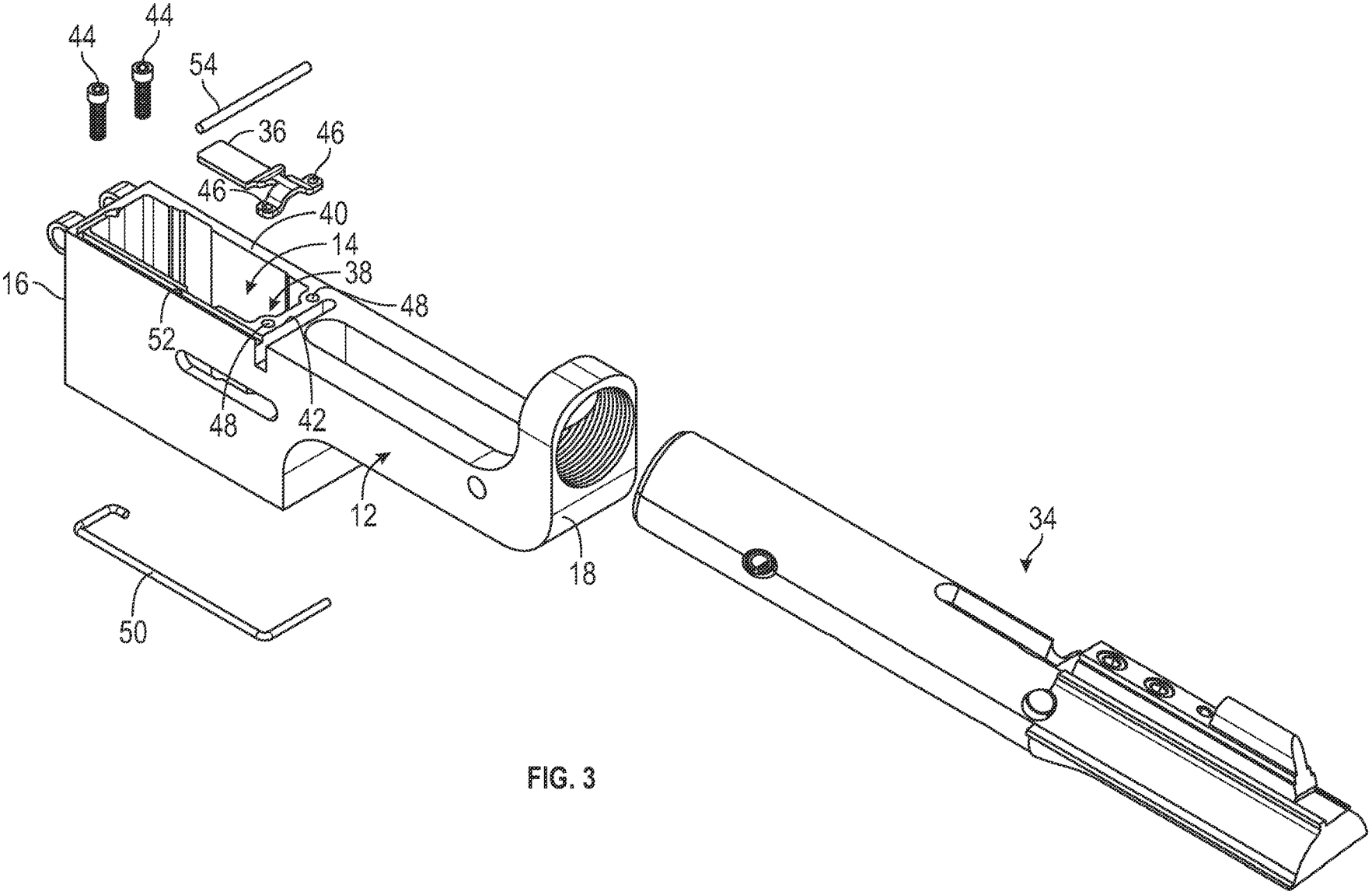
FIG. 3 is an exploded view of the lower receiver of the firearm with dual feed magazine of FIG. 1.

FIG. 3 illustrates the improved lower receiver 12 of the present invention. More particularly, the lower receiver has a depressor 36 overlaying a rear portion 38 of the magazine well 14. The lower receiver defines an upper magazine well surface 40, and the depressor extends from a rear portion 42 of the upper magazine well surface. Two mounting screws 44 pass through apertures 46 defined by the depressor and are received by threaded apertures 48 defined by the rear portion of the upper magazine well surface. A bolt hold open bar 50 is received in a channel 52 defined by the upper magazine well surface. A support pin 54 is attached to the upper receiver 22 and absorbs most of the force applied to the depressor from below by either first spring 66 or second spring 70 (shown in FIG. 6), depending on the orientation of the magazine. It should be appreciated that the support pin could instead be attached to the lower receiver 12.

Figure 4:
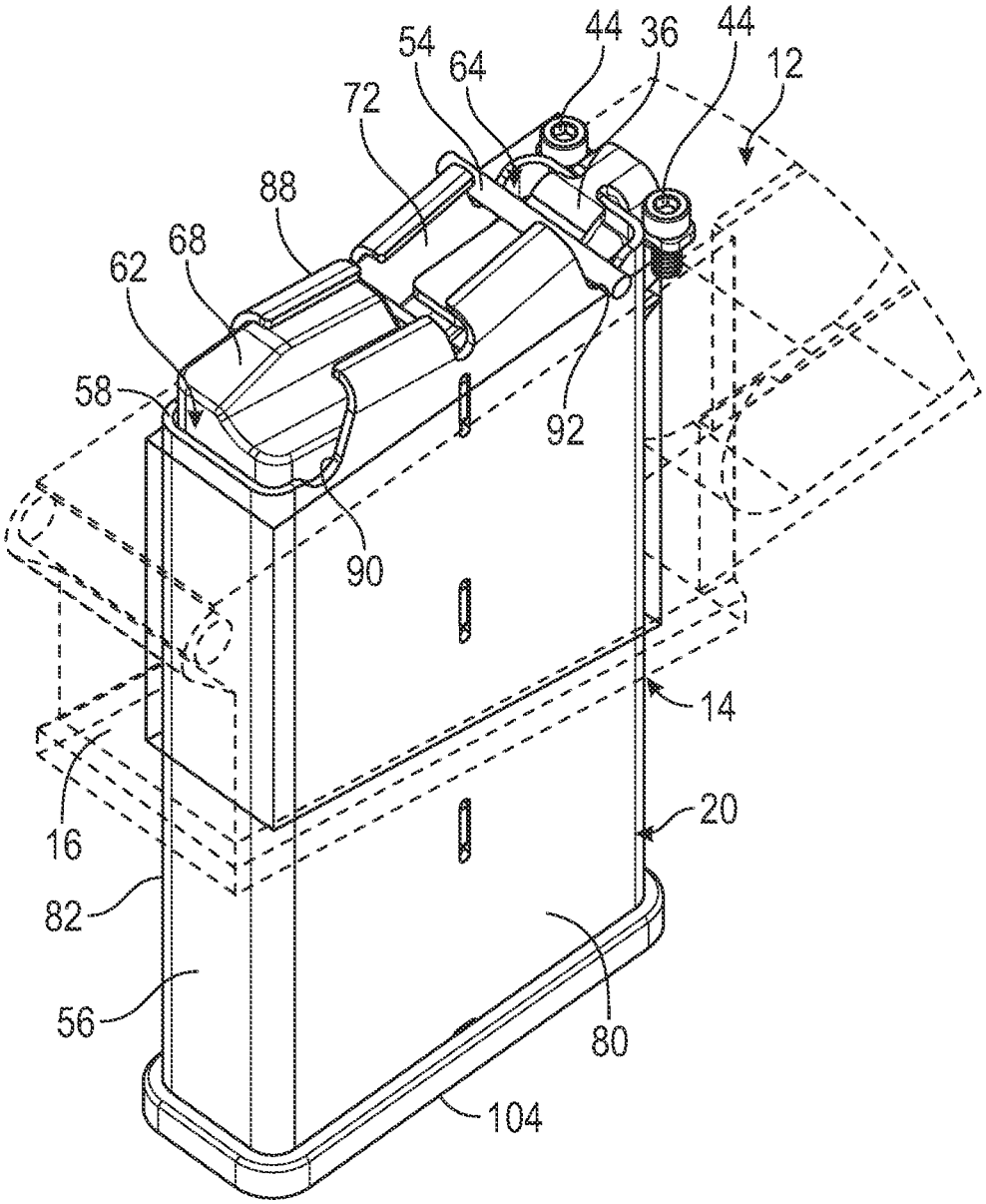
FIG. 4 is a top isometric enlarged view of the magazine installed in the magazine well of the firearm with dual feed magazine of FIG. 1.
Figure 5:
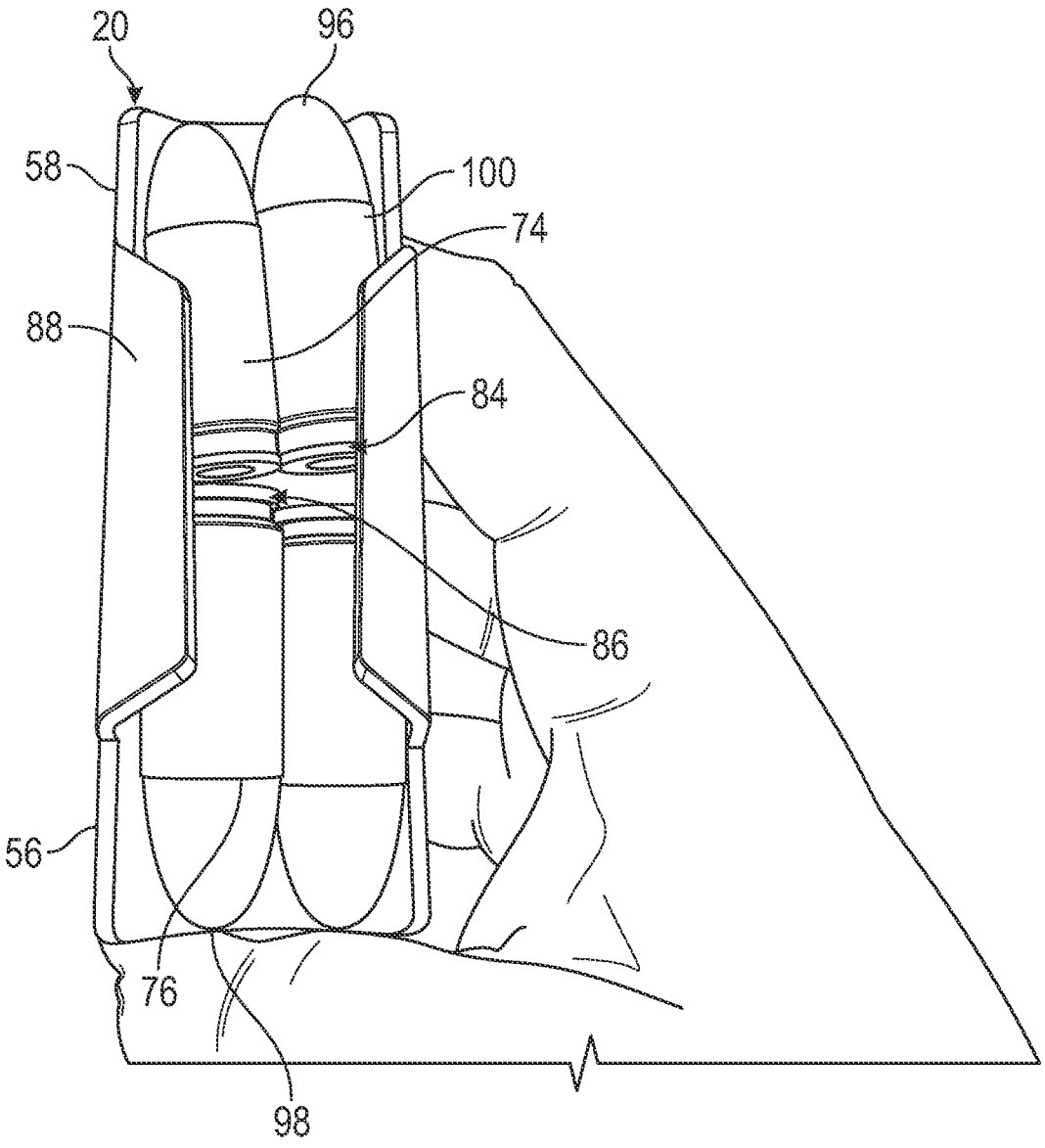
FIG. 5 is a top view of the magazine of FIG. 1 loaded with ammunition.
Figure 6:
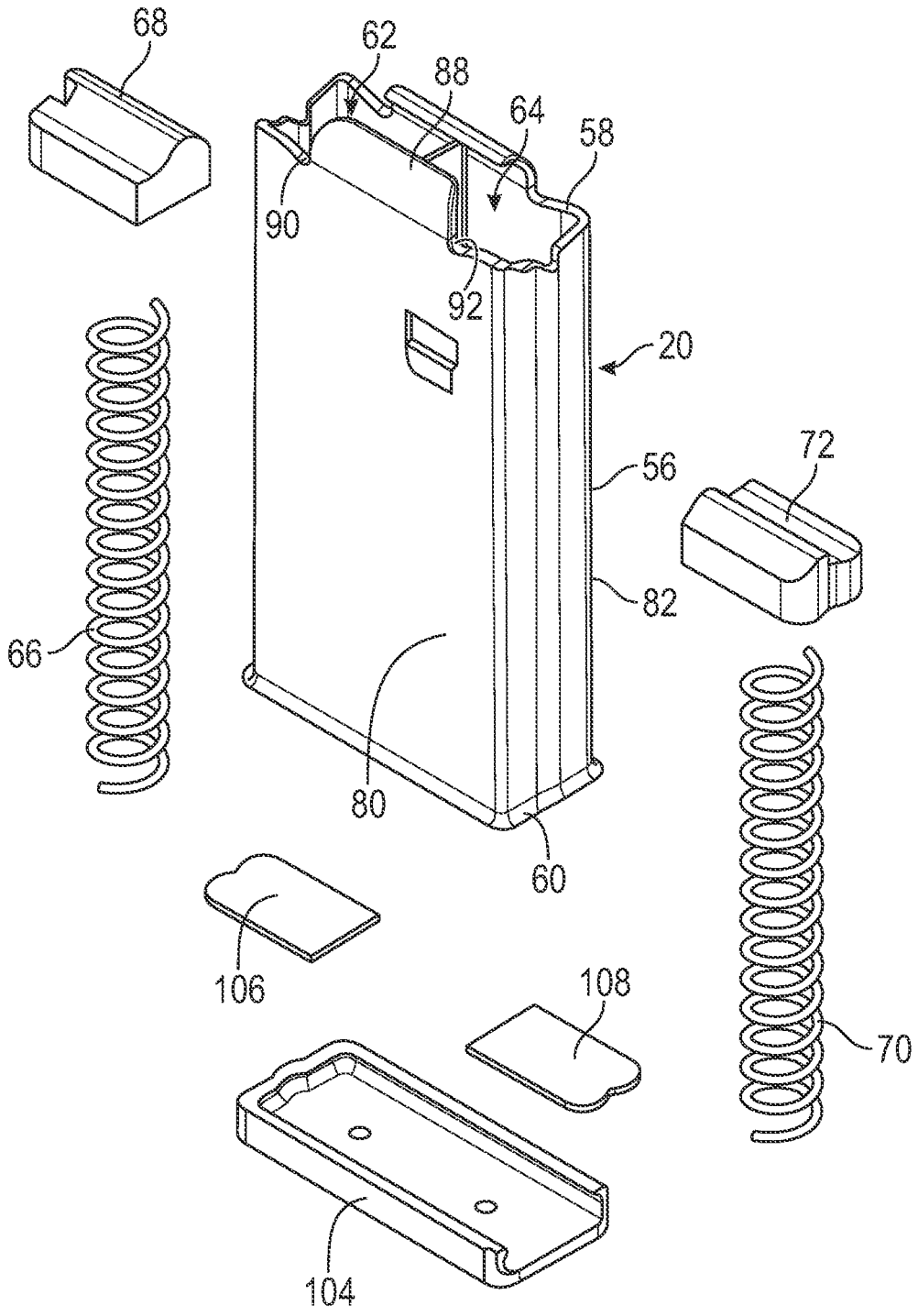
FIG. 6 is an exploded view of the magazine of FIG. 1.

FIGS. 4-6 illustrate the improved magazine 20 of the present invention. More particularly, the magazine includes a tubular body 56 having an upper end 58 and an opposed lower end 60. The tubular body defines adjacent first and second elongated passages 62, 64. A first spring 66 and first follower 68 are received in the first elongated passage. A second spring 70 and second follower 72 are received in the second elongated passage. The first elongated passage is configured to receive a first stack of ammunition (cartridges 74), and the second elongated passage is configured to receive a second stack of ammunition (cartridges 76). The springs and followers push the stacks of ammunition upwards to advance ammunition as the firearm with dual feed magazine 10 is discharged. The opposed lower end of the tubular body is closed by a magazine base plate 104. Magazine spring retaining plates 106, 108 are used to lock the magazine base plate in place. In the current embodiment, the magazine's tubular body can be made from stamped metal creating specific highly accurate bends or from moldable synthetic materials.

The tubular body 56 includes a divider 78 between the first and second elongated passages 62, 64 and is configured to separate the first stack of ammunition (cartridges 74) from the second stack of ammunition (cartridges 76). The divider is a flat wall in the current embodiment. The tubular body has opposed major sidewalls 80, 82, and where the divider extends from one major sidewall to the other major sidewall. The first and second stacks of ammunition are cartridges with case heads 84, 86 abutting the divider.

The upper end 58 of the tubular body 56 includes feed lips 88 extending above each of the first and second elongated passages 62, 64 that retain the first and second stacks of ammunition within the first and second elongated passages. Two depressions 90, 92 are defined by the upper end of the tubular body on either end of the feed lips to provide relief for the support pin 54. The first elongated passage is configured to retain the first stack of ammunition with a bullet nose 96 of each member of the first stack of ammunition (cartridges 74) facing away from the second elongated passage. The second elongated passage is configured to retain the second stack of ammunition with a bullet nose 98 of each member of the second stack of ammunition (cartridges 76) facing away from the first elongated passage. Thus, the first stack of ammunition and the second stack of ammunition have bullet noses facing in opposite directions.

Figure 7A:
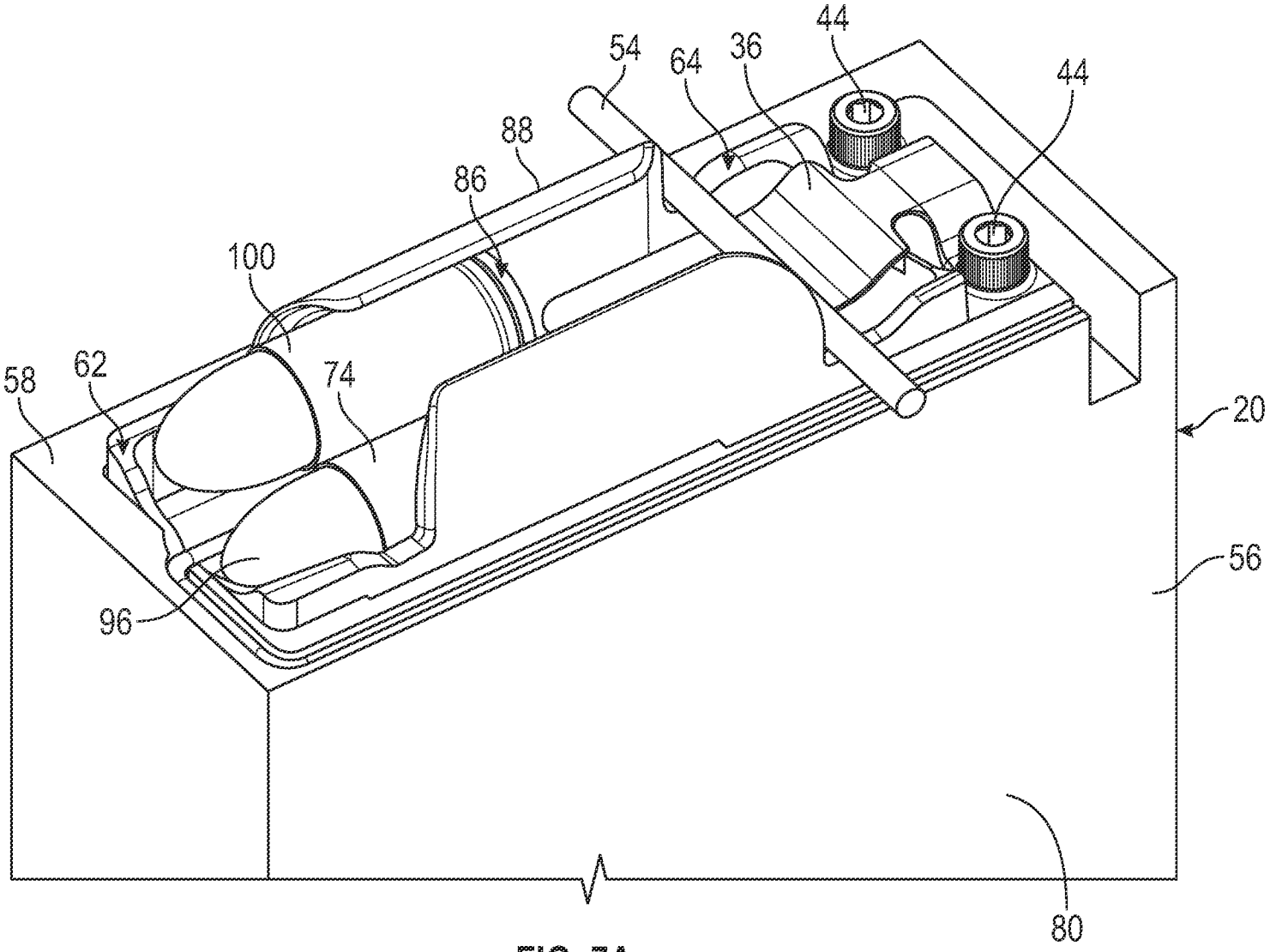
FIG. 7A is a top isometric partial view of the magazine of FIG. 1 with ammunition in the forward elongated compartment.
Figure 7B:
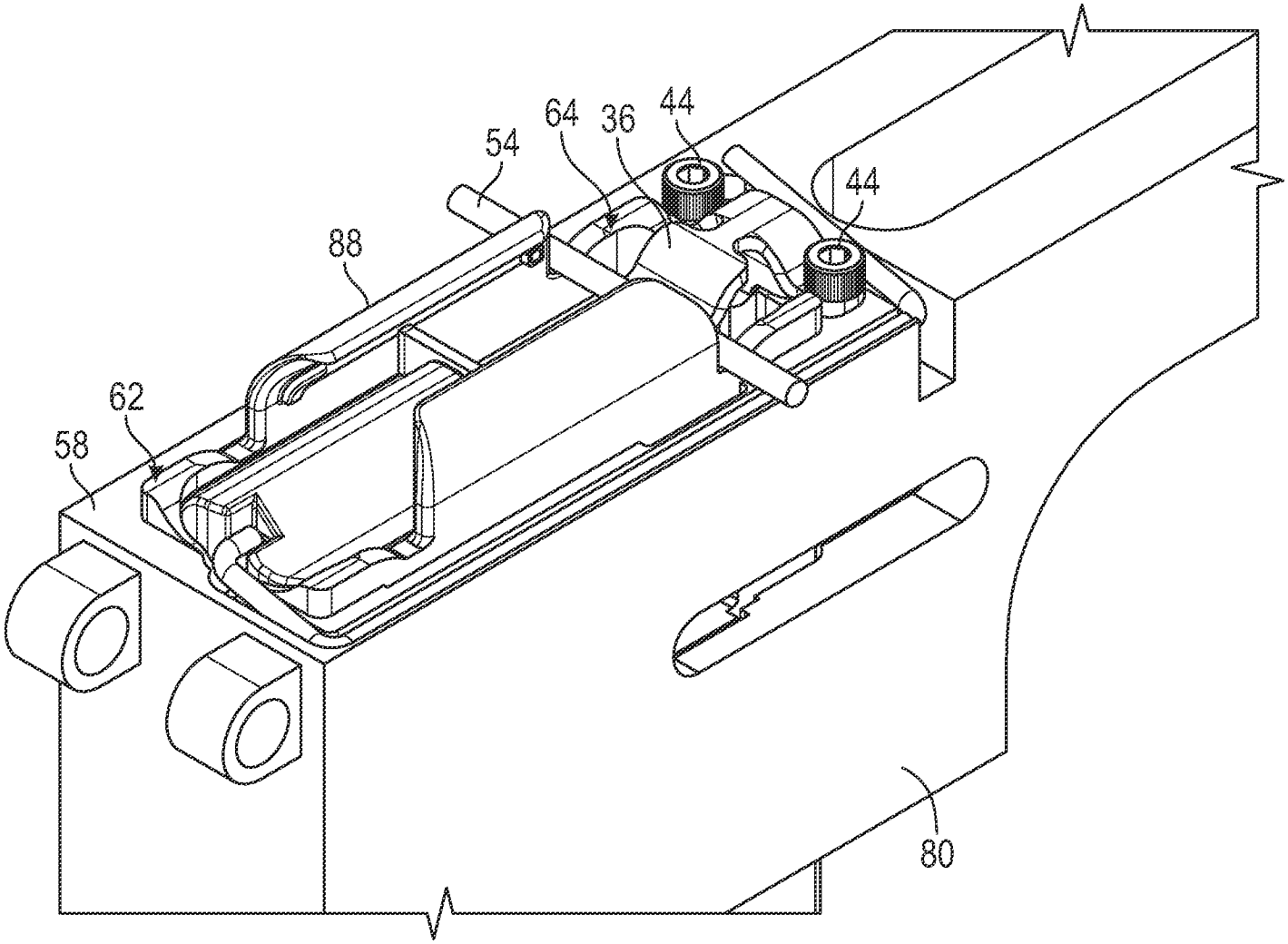
FIG. 7B is a top isometric partial view of the magazine of FIG. 1 with no ammunition in the forward elongated compartment and the bolt hold open bar raised by the follower in the forward elongated passage.
Figure 8A:
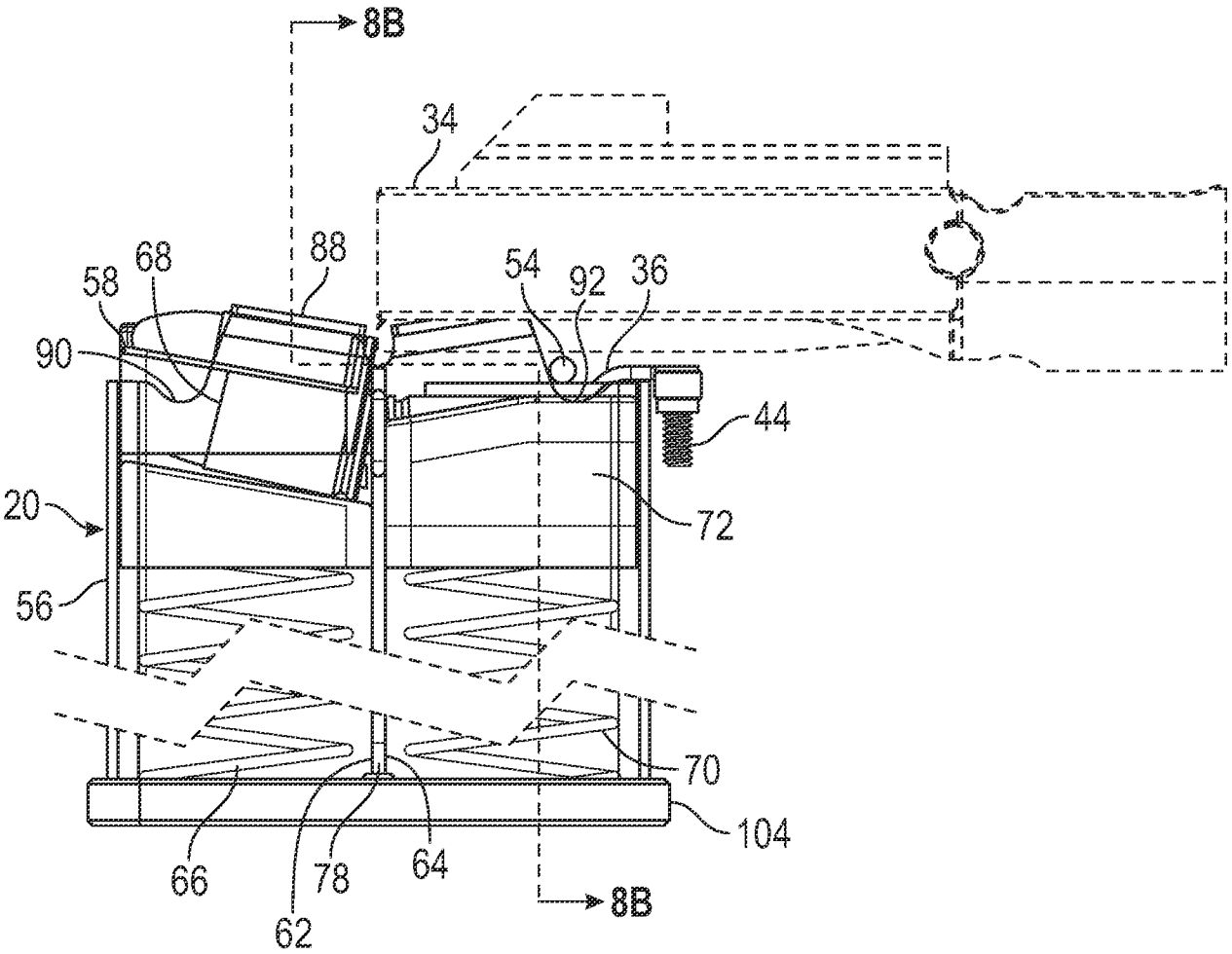
FIG. 8A is a side sectional fragmentary view of the dual feed magazine of FIG. 1 with the bolt beginning to strip the topmost round of ammunition from the forward elongated passage. No ammunition is present in the rear elongated passage.
Figure 8B:
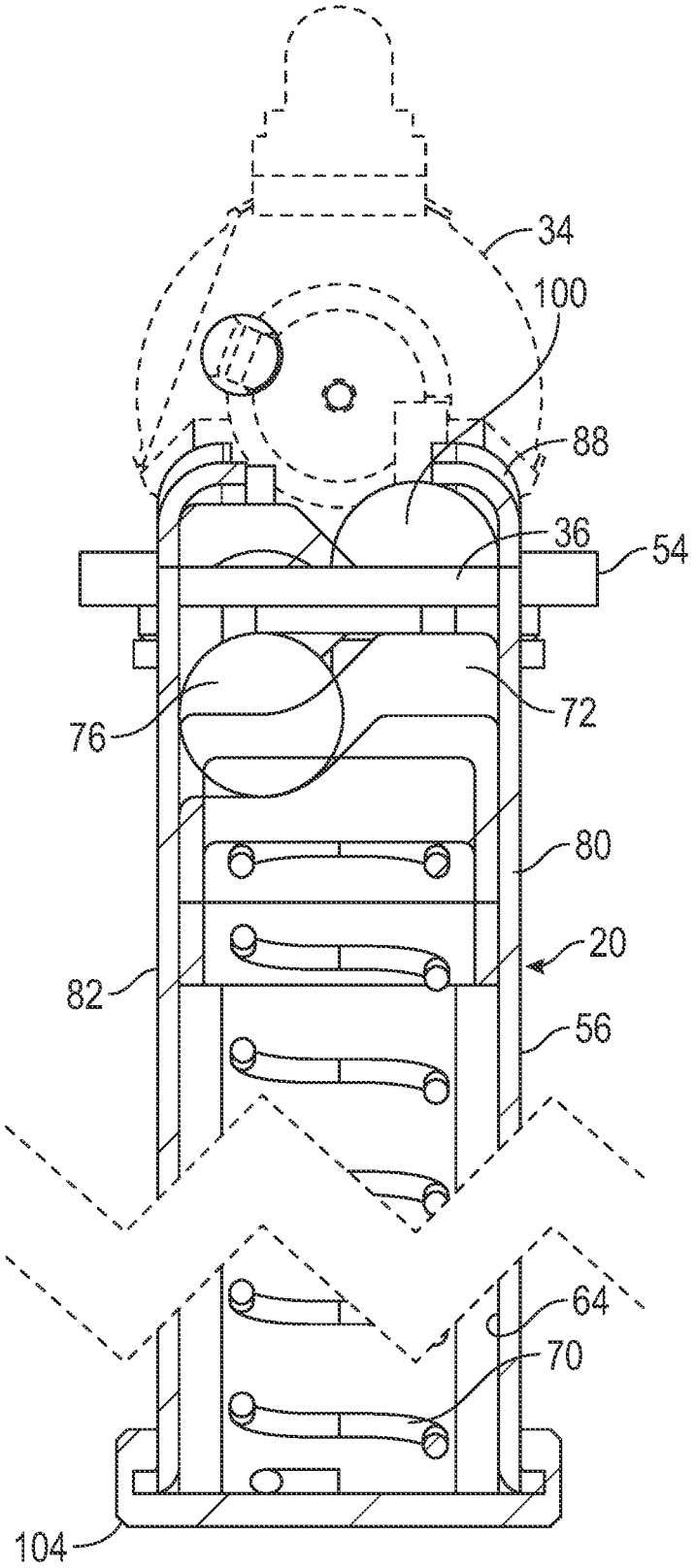
FIG. 8B is a front sectional fragmentary view taken along line 8B-8B of FIG. 8.
Figure 9A:
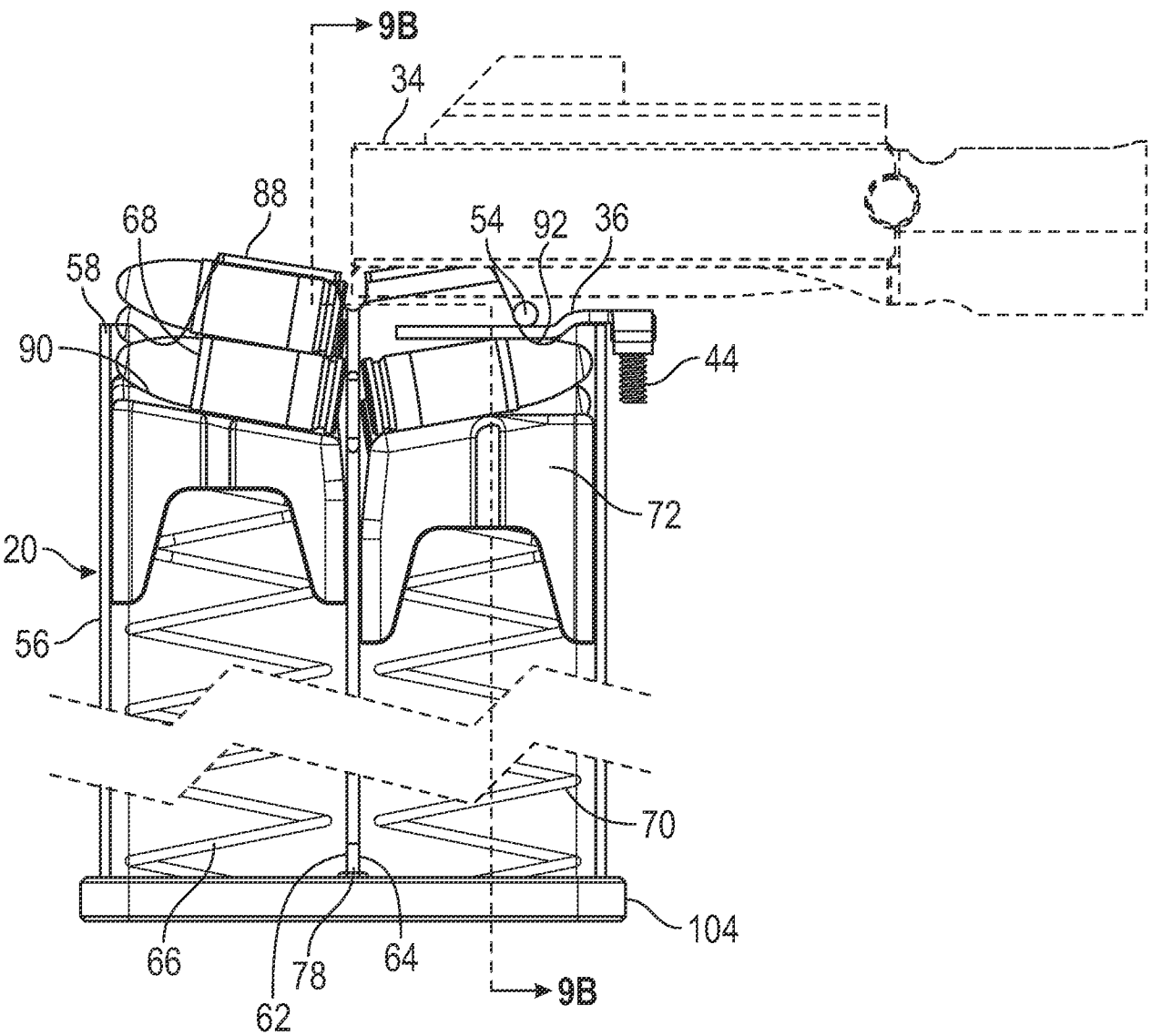
FIG. 9A is a side sectional fragmentary view of the dual feed magazine of FIG. 1 with the bolt beginning to strip the topmost round of ammunition from the forward elongated passage. Ammunition is present in the rear elongated passage.
Figure 9B:
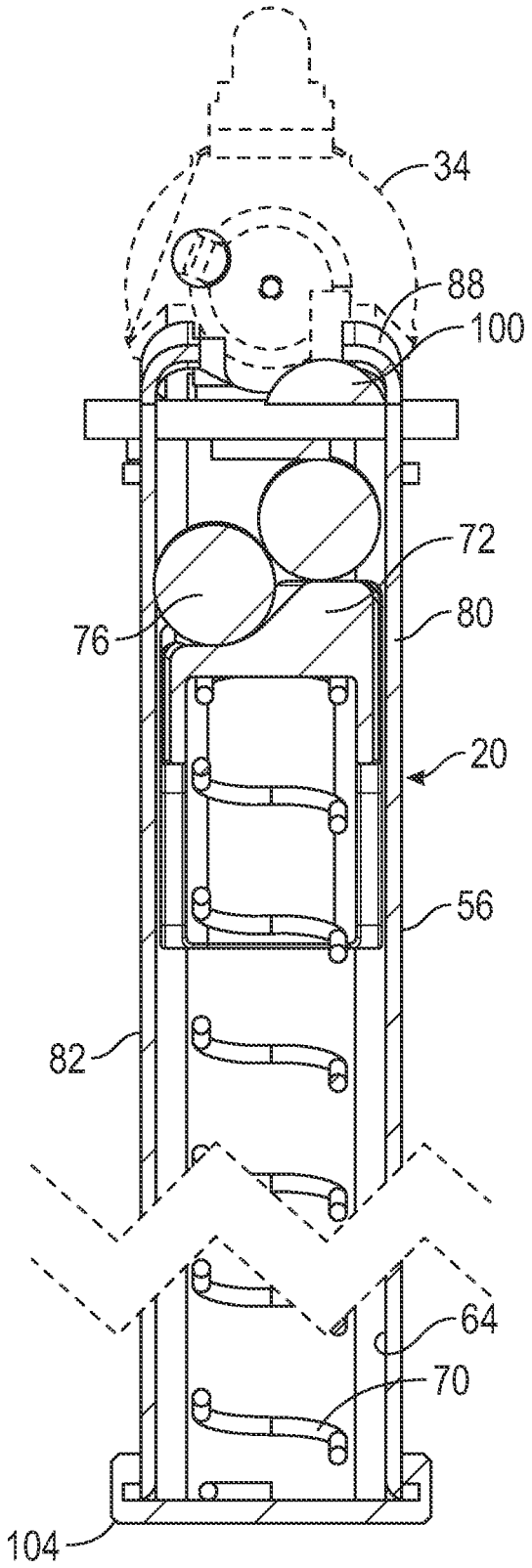
FIG. 9B is a front sectional fragmentary view taken along line 9B-9B of FIG. 8.

FIGS. 7A & 7B illustrate the improved magazine 20. More particularly, the first elongated passage 62 is shown in the loaded and unloaded conditions. The ammunition in the rear elongated passage is being pushed down by the depressor 36, which allows the bolt 34 to make contact only with forward facing ammunition. Once the first stack of ammunition is depleted, the first follower 68 contacts and raises the bolt hold open bar 50. The bolt hold open bar then transfers upward pressure to the bolt catch to hold the bolt in the open position. Holding the bolt in the open position makes reloading easier and notifies the user the ammunition is out.

FIGS. 8A-9B illustrate the improved magazine 20. More particularly, the function of the depressor 36 is shown. The depressor is configured to depress one of the first and second ammunition stacks (cartridges 74, 76) when the magazine 20 is in the retained position. When the magazine is in the retained position with the first elongated passage 62 forward of the second elongated passage 64, the bolt 34 is operable to strip a top cartridge 100 from the first stack of ammunition without contacting the second stack of ammunition. This occurs because the depressor 36 holds the second stack of ammunition down below the height of the first stack of ammunition and below the bolt's path of travel, which is shown in FIGS. 9A & B. The depressor has a large surface area to avoid dimpling or damaging the brass casing of the cartridges.

The magazine 20 is considered to be dual feed because the magazine organizes ammunition into two separate elongated passages of back-to-back opposite facing ammunition stacks. The two ammunition stacks in this orientation allow the overall dimensions of the magazine to stay the same as standard AR-15 magazines. This allows the use of standard magazine pouches currently in widespread use. By having two separate elongated passages opposing each other in a rotationally symmetrical tubular body, reloads can be accomplished by simply removing the magazine from the magazine well, rotating the magazine 180°, and inserting the magazine into the magazine well. These features double the capacity of the magazine relative to conventional magazines and makes reloads faster and easier.

The magazine 20 enables pistol caliber cartridges (9 mm cartridges are illustrated) to be stacked in the most efficient way possible by placing the cartridges back-to-back in two vertical rows. The dimensions of an AR-15 magazine were chosen because those dimensions have been utilized to design storage pouches, cases, etc. for a very long time. Compatibility with a wide range of accessories provides the firearm with dual feed magazine 10 with significant competitive advantages over any other pistol-caliber carbine.

Furthermore, the preferred embodiment not only is able to provide a double column magazine, but it does so with a selected pistol cartridge with an overall length approximately half the overall length of a typical 223 cartridge. This not only enables the use of the same accessories such as magazine pouches, but also enables the firearm lower receiver to be made at either a similar scale or the same scale as typical AR-15 rifles.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a firearm with dual feed magazine has been described in detail, it should be apparent that modifications and variations thereto are possible, all of which fall within the true spirit and scope of the invention. Although rifles have been disclosed, the firearm with dual feed magazine could also be a pistol or machine gun. Furthermore, although each elongated passage having its own spring has been disclosed, a single long "U" bent spring shared by both elongated passages could be used. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm comprising:

a frame defining a magazine well;

the frame defining a longitudinal axis defining a forward and rearward direction along the longitudinal axis;

a magazine configured to be received in the magazine well in a retained position;

the magazine including a tubular body having an upper end and an opposed lower end;

the tubular body defining adjacent first and second elongated passages;

the first elongated passage being forward of the second elongated passage;

a first spring and first follower received in the first elongated passage;

a second spring and second follower received in the second elongated passage;

the first elongated passage configured to receive a first stack of ammunition; and the second elongated passage configured to receive a second stack of ammunition.

2. The firearm of claim 1 wherein the tubular body includes a divider between the first and second elongated passages and is configured to separate the first stack of ammunition from the second stack of ammunition.

3. The firearm of claim 2 wherein the divider is a flat wall.

4. The firearm of claim 2 wherein the tubular body has opposed major sidewalls, and where the divider extends from one major sidewall to the other major sidewall.

5. A firearm comprising:

a frame defining a magazine well and defining a forward and rearward direction;

a magazine configured to be received in the magazine well in a retained position;

the magazine including a tubular body having an upper end and an opposed lower end;

the tubular body defining adjacent first and second elongated passages, a first spring and first follower received in the first elongated passage;

a second spring and second follower received in the second elongated passage;

the first elongated passage configured to receive a first stack of ammunition having case heads facing the second passage;

the second elongated passage configured to receive a second stack of ammunition having case heads facing the first passage; and wherein the tubular body includes a divider between the first and second elongated passages and is configured to separate the first stack of ammunition from the second stack of ammunition with case heads abutting the divider.

6. The firearm of claim 1 wherein the upper end of the tubular body includes feed lips extending above each of the first and second elongated passages.

7. A firearm comprising:

a frame defining a magazine well and defining a forward and reward direction;

a magazine configured to be received be magazine well in a retained position;

the magazine including a tubular body having an upper end and an opposed lower end;

the tubular body adjacent first and second elongated passages, a first spring and first follower received in the first elongated passage;

a second spring and second follower received in the second elongated passage;

the first elongated passage configured to receive a first stack of ammunition;

the second elongated passage configured to receive a second stack of ammunition, and wherein the first elongated passage is configured to retain the first stack of ammunition with a bullet nose of each member of the first stack of ammunition facing away from the second elongated passage.

8. The firearm of claim 7 wherein the second elongated passage is configured to retain the second stack of ammunition with a bullet nose of each member of the second stack of ammunition facing away from the first elongated passage.

9. A firearm comprising:

a frame defining a magazine well and defining a forward and rearward direction;

a magazine configured to be received in the magazine well in a retained position;

the magazine including a tubular body having an upper end and an opposed lower end;

the tubular body defining adjacent first and second elongated passages;

a first spring and first follower received in the first elongated passage;

a second spring and second follower received in the second elongated passage; and the first elongated passage configured to receive a first stack of ammunition having bullet noses facing away from the second passage and the second elongated passage is configured to receive a second stack of ammunition having noses facing away from the first passage such that the magazine is configured to receive the first stack of ammunition and the second stack of ammunition with bullet noses facing in opposite directions.

10. A firearm comprising:

a frame defining a magazine well and defining a forward and rearward direction;

a magazine configured to be received in the magazine well in a retained position;

the magazine including a tubular body having an upper end and an opposed lower end;

the tubular body defining adjacent first and second elongated passages;

a first spring and first follower received in the first elongated passage;

a second spring and second follower received in the second elongated passage;

the first elongated passage configured to receive a first stack of ammunition;

the second elongated passage configured to receive a second stack of ammunition;

wherein the frame includes a depressor fixed to the frame and overlaying a rear portion of the magazine well.

11. The firearm of claim 10 wherein the depressor is configured to depress one of the first and second ammunition stacks when the magazine is in the retained position.

12. The firearm of claim 10 wherein the frame defines an upper magazine well surface, and wherein the depressor extends from a rear portion of the upper magazine well surface.

13. A firearm comprising:

a frame defining a magazine well and defining a forward and rearward direction;

a magazine configured to be received in the magazine well in a retained position;

the magazine including a tubular body having an upper end and an opposed lower end;

the tubular body defining adjacent first and second elongated passages;

a first spring and first follower received in the first elongated passage;

a second spring and second follower received in the second elongated passage;

the first elongated passage configured to receive a first stack of ammunition;

the second elongated passage configured to receive a second stack of ammunition; and including a bolt operable to reciprocate in the frame and when the magazine is in the retained position with the first elongated passage forward of the second elongated passage, to strip a top cartridge from the first stack of ammunition without contacting the second stack of ammunition.

* * * * *